US009435603B2

(12) United States Patent
Choi et al.

(10) Patent No.: US 9,435,603 B2
(45) Date of Patent: Sep. 6, 2016

(54) REMOTE WEAPON SYSTEM AND CONTROL METHOD THEREOF

(71) Applicant: HANWHA TECHWIN CO., LTD., Changwon-Si (KR)

(72) Inventors: Jaeyoon Choi, Changwon-si (KR); Jaehwan Lee, Changwon-si (KR); Younghoon Kim, Changwon-si (KR)

(73) Assignee: Hanwha Techwin Co., Ltd., Changwon-si (KR)

( * ) Notice: Subject to any disclaimer, the term of this patent is extended or adjusted under 35 U.S.C. 154(b) by 0 days.

(21) Appl. No.: 14/610,098

(22) Filed: Jan. 30, 2015

(65) Prior Publication Data

US 2015/0300765 A1 Oct. 22, 2015

(30) Foreign Application Priority Data

Apr. 16, 2014 (KR) ..... 10-2014-0045492

(51) Int. Cl.

| | |
|---|---|
| ***G06F 19/00*** | (2011.01) |
| ***F41A 27/30*** | (2006.01) |
| ***F41G 3/12*** | (2006.01) |
| ***F41G 5/24*** | (2006.01) |
| *F41H 7/00* | (2006.01) |

(52) U.S. Cl.

CPC ..... *F41A 27/30* (2013.01); *F41G 3/12* (2013.01); *F41G 5/24* (2013.01); *F41H 7/005* (2013.01)

(58) Field of Classification Search

CPC ..... F41G 3/12; F41G 5/24; F41A 27/30; F41A 27/28; F41H 7/005

USPC ..... 235/400

See application file for complete search history.

(56) References Cited

U.S. PATENT DOCUMENTS

| | | | | |
|---|---|---|---|---|
| 4,480,524 | A | 11/1984 | Blomqvist et al. | |
| 5,631,437 | A | 5/1997 | LaVigna et al. | |
| 5,834,677 | A * | 11/1998 | Muller | F41A 27/30 89/41.06 |
| 5,966,859 | A * | 10/1999 | Samuels | F41A 17/066 42/70.11 |
| 5,974,940 | A * | 11/1999 | Madni | F41A 21/48 42/119 |
| 6,497,171 | B2 | 12/2002 | Gerber et al. | |
| 7,549,367 | B2 * | 6/2009 | Hill | F41A 27/30 89/136 |
| 8,555,771 | B2 | 10/2013 | Kude | |
| 2006/0005447 | A1 * | 1/2006 | Lenner | F41G 3/06 42/111 |
| 2007/0057842 | A1 * | 3/2007 | Coleman | H01Q 3/02 342/359 |
| 2012/0037702 | A1 * | 2/2012 | Kude | F41G 3/12 235/407 |

(Continued)

FOREIGN PATENT DOCUMENTS

| | | | |
|---|---|---|---|
| JP | 2002-31498 | A | 1/2002 |
| JP | 2008-309375 | A | 12/2008 |

*Primary Examiner* — Thien M Le
*Assistant Examiner* — Claude J Brown
(74) *Attorney, Agent, or Firm* — Sughrue Mion, PLLC

(57) ABSTRACT

Provided is a remote weapon device including a firing arm configured to fire a bullet at a target in response to a firing signal; a driver coupled to the firing arm and configured to move the firing arm to aim the firing arm at the target; a detector configured to detect shaking of the firing arm with respect to a zero position, the zero position corresponding to a position at which the firing arm points at the target and fires the bullet at the target; and a controller configured to obtain a shaking pattern based on the detected shaking and configured to generate the firing signal controlling a firing time when the firing arm fires the bullet according to the shaking pattern to control the firing arm to fire the bullet.

17 Claims, 6 Drawing Sheets

(56) References Cited

U.S. PATENT DOCUMENTS

2012/0042559 A1* 2/2012 Bockmon ..... F41A 27/30
42/111
2012/0132709 A1* 5/2012 Lowrey, III ..... F41C 27/22
235/407
2012/0297658 A1* 11/2012 Lupher ..... F41A 17/06
42/69.01
2013/0028486 A1* 1/2013 Backlund ..... F41G 1/38
382/107
2014/0028856 A1* 1/2014 Ehrlich ..... F41A 17/08
348/169
2014/0360072 A1* 12/2014 Lupher ..... F41G 1/38
42/69.01
2014/0360081 A1* 12/2014 Lupher ..... F41G 1/38
42/120
2015/0101229 A1* 4/2015 Hall ..... F41A 19/64
42/69.01

* cited by examiner

REMOTE WEAPON SYSTEM AND CONTROL METHOD THEREOF

CROSS-REFERENCE TO RELATED APPLICATION

This application claims priority from Korean Patent Application No. 10-2014-0045492, filed on Apr. 16, 2014, in the Korean Intellectual Property Office, the disclosure of which is incorporated herein in its entirety by reference.

BACKGROUND

1. Field

Apparatuses and methods consistent with exemplary embodiments relate to a remote weapon system and a control method thereof, and more particularly, to a remote weapon system which improves the shooting accuracy of a gun, and a control method thereof.

2. Description of the Related Art

As science and technology rapidly develop after the Industrial Revolution, weapons used in wars and methods of using the weapons have been greatly changed. It has been the biggest purpose of the development of technology to ensure safety of a person who directly operates various machines or weapons against an enemy.

In general, the most commonly used weapons during wars are guns and artillery guns. The guns and artillery guns may be carried directly by persons or installed on platforms such as armored vehicles and guard ships so that persons may aim and fire the guns. However, the armored vehicles and guard ships may be easily targeted by an enemy and thus persons who operate the weapons installed on the armored vehicles and guard ships may be easily exposed to the enemy and be at a risk of being injured or killed.

To address the above matter, instead of the manually operated guns or artillery guns, remote weapons capable of automatically aiming and firing have been installed on platforms, which may reduce human casualties. However, the shooting accuracy may be lowered due to continuous/repeated vibrations of a gun.

To solve the above phenomenon of the decreased shooting accuracy, a method of reducing vibrations of a barrel by improving the rigidity or damping properties of a remote weapon has been used. To this end, the structure of a weapon may be reinforced by increasing the total weight of a remote weapon or installing a special connection member. However, when the intrinsic mechanical properties such as a shape, a material, or rigidity of the remote weapon are changed, design conditions of a remote weapon system that controls the remote weapon need to be changed accordingly.

In addition, a remote weapon system of the related art is controlled by a closed-loop control system. The closed-loop control system is a control method that detects an output signal of the control system, that is, vibrations of a barrel, and continuously reflects the detected signal in an input signal of the control system, thereby correcting an input. When the closed-loop control system is employed, feedback is needed to obtain a desired output and thus the structure of a control system is complicated and costs for embodying the whole control system increase.

SUMMARY

One or more exemplary embodiments provide a remote weapon system having an improved shooting accuracy, and a control method thereof.

One or more exemplary embodiments provide a remote weapon system which may be universally incorporated to satisfy various design conditions, and a control method thereof.

One or more exemplary embodiments provide a remote weapon system equipped with a control system that is simple and inexpensive, and a control method thereof.

Additional aspects will be set forth in part in the description which follows and, in part, will be apparent from the description, or may be learned by practice of the presented embodiments.

According to an aspect of an exemplary embodiment, there is provided a remote weapon device including a firing arm configured to fire a bullet at a target in response to a firing signal; a driver coupled to the firing arm and configured to move the firing arm to aim the firing arm at the target; a detector configured to detect shaking of the firing arm with respect to a zero position, the zero position corresponding to a position at which the firing arm points at the target and fires the bullet at the target; and a controller configured to obtain a shaking pattern based on the detected shaking and configured to generate the firing signal controlling a firing time when the firing arm fires the bullet according to the shaking pattern to control the firing arm to fire the bullet.

The shaking pattern may be obtained during the firing arm firing a plurality of bullets.

The controller may be configured to control the driver to position the firing arm at the zero position according to the shaking pattern.

The controller may be configured to analyze the shaking pattern of the firing arm, configured to determine a time when the firing arm returns to the zero position after firing the bullet as the firing time and configured to generate the firing signal according to the time when the firing arm returns to the zero position.

The driver may include: a motor configured to move the firing arm; and a motor driver configured to apply a driving signal to the motor.

The motor may be configured to rotate the firing arm.

The controller may include: a determination processor configured to analyze the shaking pattern and configured to determine a control torque controlling the position of the firing arm to be positioned at the zero position at the firing time when the bullet is fired; and a signal converter configured to convert the control torque to an electric signal and configured to transmit the electric signal to the motor driver.

The motor driver may be configured to generate the driving signal based on the control torque, configured to transmit the driving signal to the motor and configured to correct the shaking of the firing arm.

The controller is connected to the firing arm, the driver, and the detector.

The controller may be configured to generate the firing signal using an open-loop control method.

The controller may be configured to identify intrinsic physical properties of the remote weapon device based on a plurality of preliminary firings of the firing arm and the shaking of the firing arm.

According to an aspect of another exemplary embodiment, there is provided a method of controlling a remote weapon including detecting shaking of a firing arm with respect to a zero position corresponding to a position at which the firing arm points at a target and fires a plurality of bullets at the target; generating a firing signal controlling the firing arm to fire a bullet according to the shaking pattern; and firing, by the firing arm, the bullet in response to the firing signal.

The generating the firing signal may include: analyzing the shaking pattern of the firing arm; and generating the firing signal by determining a time when the firing arm returns to the zero position after firing the bullet as a firing time.

In the generating the firing signal, the firing signal may be generated by determining a time when the firing arm is located at a position close to the zero position, as a firing time, and the method may further include: determining a control torque to control the position of the firing arm to be located at the zero position at the firing time; and driving a driver configured to move the firing arm according to the control torque to control the position of the firing arm to be located at the zero position at the firing time.

The generating the firing signal may include generating the firing signal using an open-loop control method.

The generating the firing signal may further include identifying intrinsic physical properties of the remote weapon based on a plurality of preliminary firings of the firing arm and the shaking of the firing arm.

BRIEF DESCRIPTION OF THE DRAWINGS

The above and/or other aspects will become apparent and more readily appreciated from the following description of exemplary embodiments, taken in conjunction with the accompanying drawings in which.

DETAILED DESCRIPTION

Figure 1:
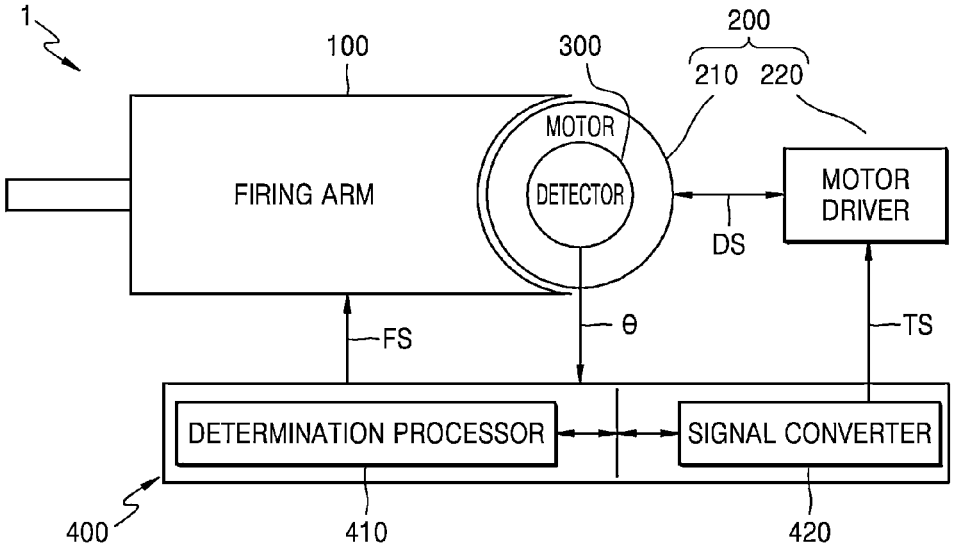
FIG. 1 illustrates an overall structure of a remote weapon system according to an exemplary embodiment.

Reference will now be made in detail to exemplary embodiments, examples of which are illustrated in the accompanying drawings, wherein like reference numerals refer to like elements throughout. In this regard, the exemplary embodiments may have different forms and should not be construed as being limited to the descriptions set forth herein. Accordingly, the exemplary embodiments are merely described below, by referring to the figures, to explain aspects of the present description.

FIG. 1 illustrates an overall structure of a remote weapon system 1 according to an exemplary embodiment.

Referring to FIG. 1, the remote weapon system 1 may include a firing arm 100 that fires bullets, a driver 200 that drives the firing arm 100, a detector 300 that detects shaking of the firing arm 100, and a controller 400 controlling firing time of the firing arm 100. The remote weapon system 1 may be installed on various platforms, mainly on platforms such as armored vehicles or tanks that are operated on the ground and equipped with firearms such as the remote weapon system 1. However, the exemplary embodiment is not limited thereto, and the remote weapon system 1 may be installed not only on a ground platform but also on a naval platform.

The firing arm 100 fires the bullets by receiving a firing signal FS from the controller 400.

The driver 200 is coupled to the firing arm 100 and move (e.g., repositions or rotates) the firing arm 100 to aim the firing arm 100 at a target. In detail, the driver 200 includes a motor 210 and a motor driver 220. The motor 210 is connected to the firing arm 100 to aim the firing arm 100 at the target. The motor driver 220 drives the motor 210 and applies a driving signal DS that is an electric signal to the motor 210 in order to change the position of the firing arm 100.

The detector 300, as illustrated in FIG. 1, may be installed on the motor 210. However, the exemplary embodiment is not limited thereto, and the detector 300 may be installed on the firing arm 100. The detector 300 detects shaking 8 (refer to FIG. 2) of the firing arm 100 from a zero position pointing at a target when the firing arm 100 fires bullets.

The expression "a zero position pointing at a target" means a position where the firing arm 100 points at a target in an initial state, that is, before firing bullets. Accordingly, the detector 300 detects a degree of shaking 8 of the firing arm 100 while bullets are fired, with respect to the position of the firing arm 100 before the bullets are fired.

The controller 400 receives the shaking 8 of the firing arm 100 that is detected by the detector 300 while bullets are fired several times and obtains a shaking pattern (refer to FIG. 3) of the firing arm 100. Then, the controller 400 generates the firing signal FS by using the shaking pattern and transmits the firing signal FS to the firing arm 100, thereby controlling firing time when bullets are fired.

Figure 2:
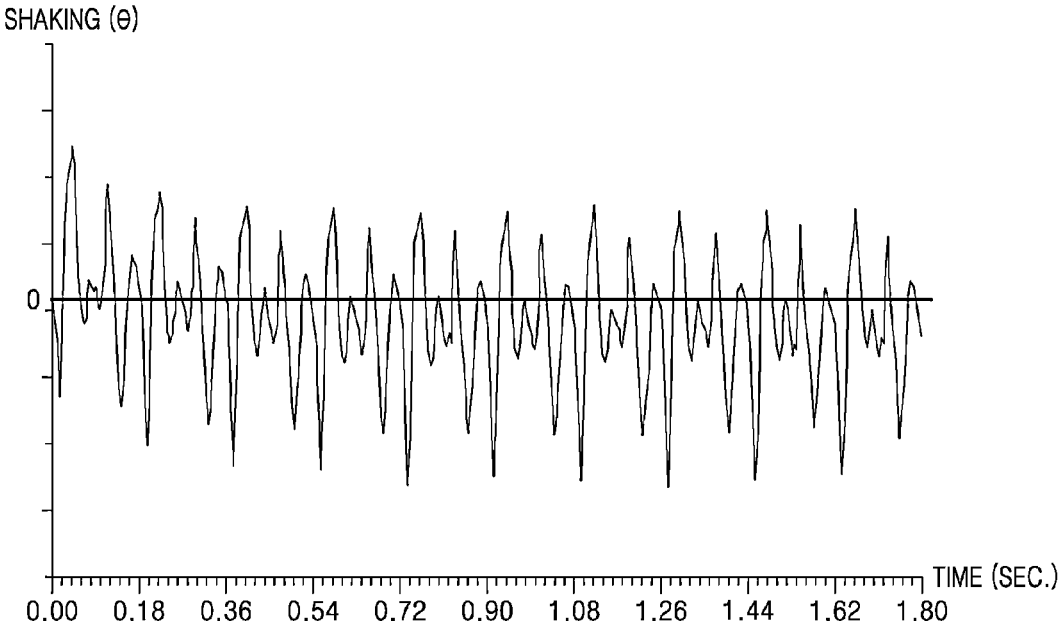
FIG. 2 is a graph showing shaking of a firing arm detected by a detector while ten bullets are fired as the remote weapon system of FIG. 1 operates according to an exemplary embodiment.

FIG. 2 is a graph showing shaking of the firing arm 100 that is detected by the detector 300 while ten bullets are fired as the remote weapon system 1 of FIG. 1 operates.

Referring to FIG. 2, ten (10) bullets are consecutively fired at a constant firing interval for a period of about 1.8 seconds. Accordingly, the firing interval for the ten bullets is 0.18 seconds. It may be seen from the graph of FIG. 2 that shaking of the firing arm 100 is similar with one another every 0.18 seconds. Based on the above information, the shakings repeated every 0.18 seconds are illustrated to be overlapped with one another in one graph of FIG. 3.

Figure 3:
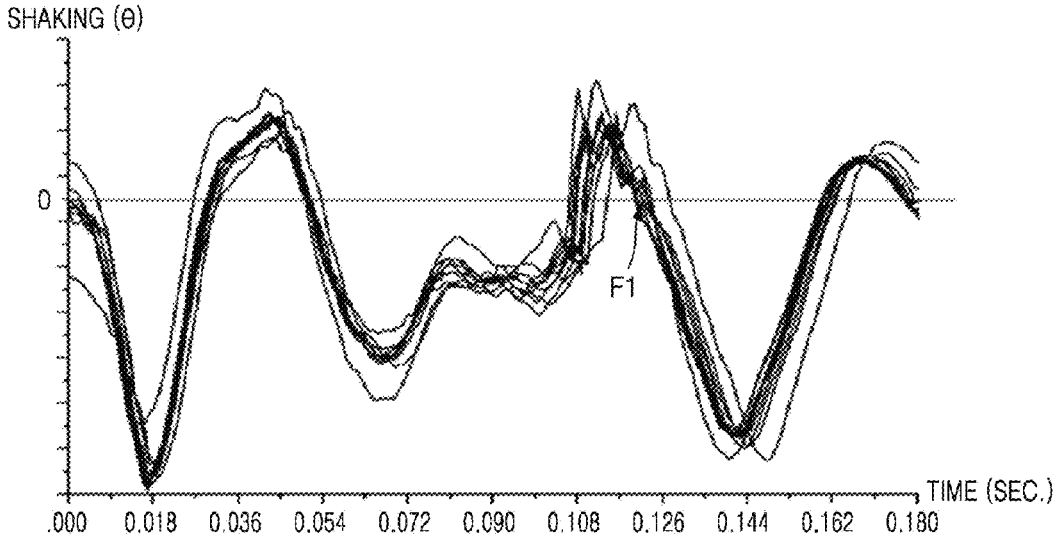
FIG. 3 is a graph showing a shaking pattern of the firing arm obtained by overlapping the shakings of the firing arm within a firing interval of about 0.18 seconds by dividing the graph of FIG. 2 into ten sections, and that a time when the firing arm of FIG. 1 returns to a zero position after firing a bullet is selected as a firing time F1 according to an exemplary embodiment.
Figure 4A:
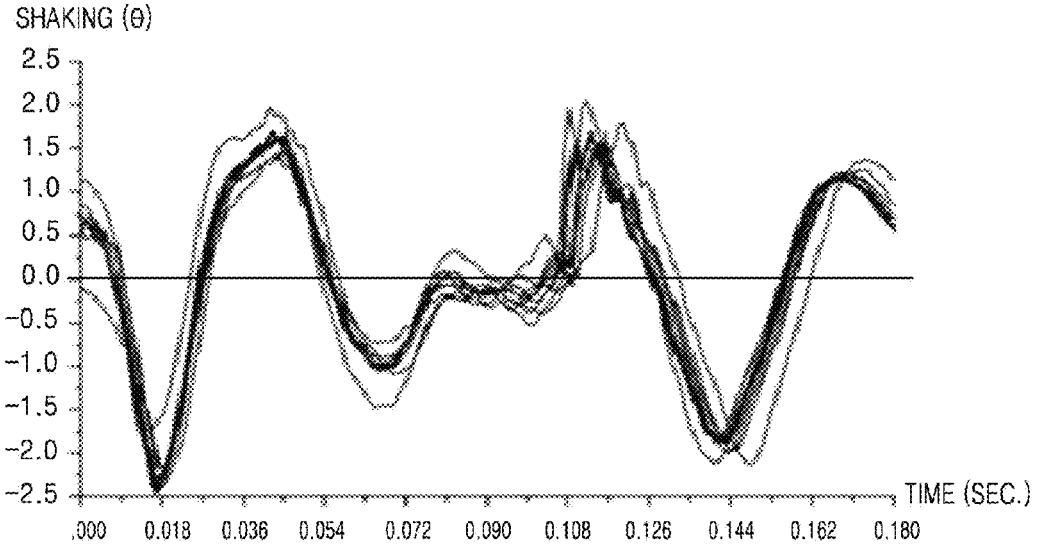
FIGS. 4A to 4D are graphs showing shaking patterns of the firing arm of a remote weapon system according to an exemplary embodiment under various firing conditions having different intrinsic physical properties.
Figure 4B:
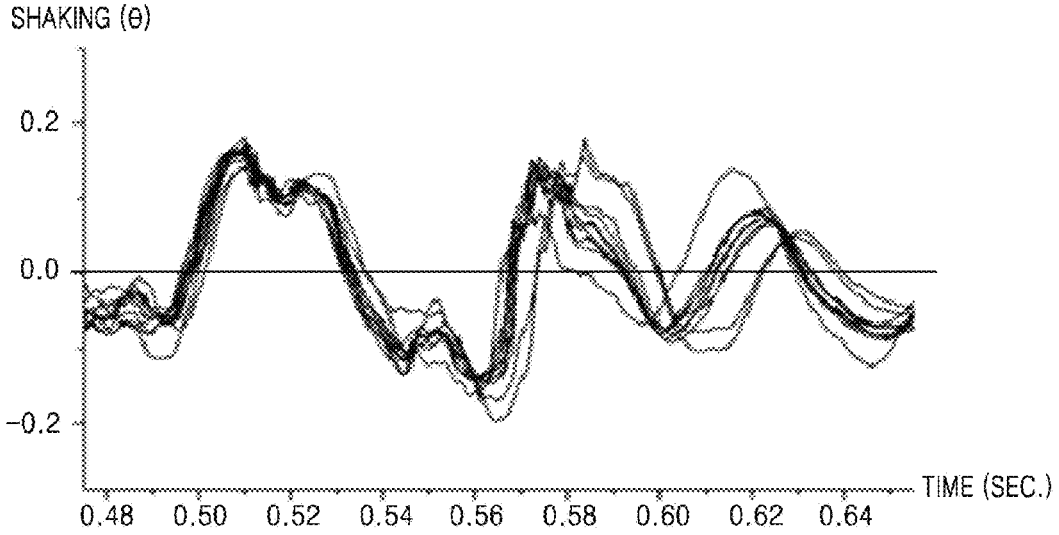
Figure 4C:
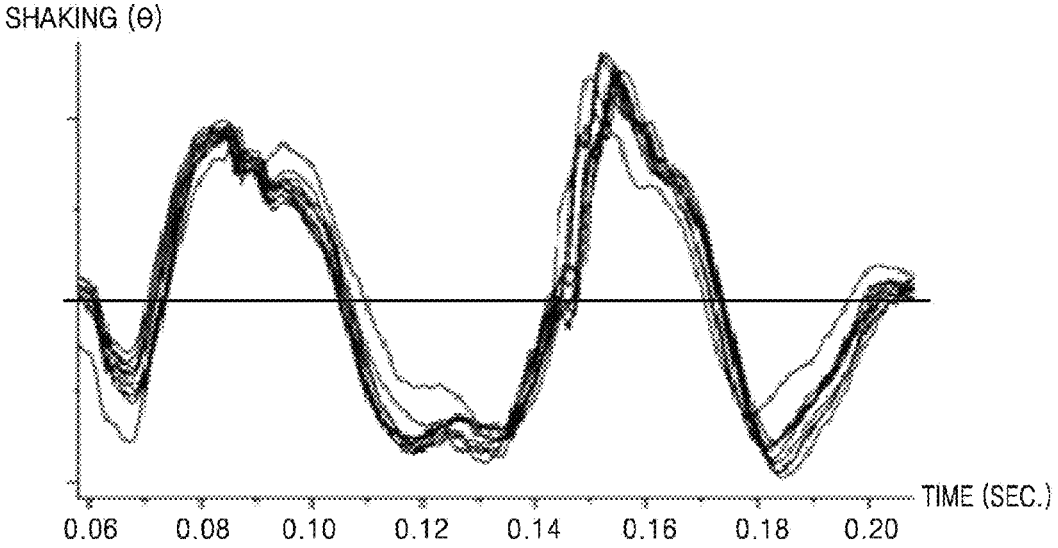
Figure 4D:
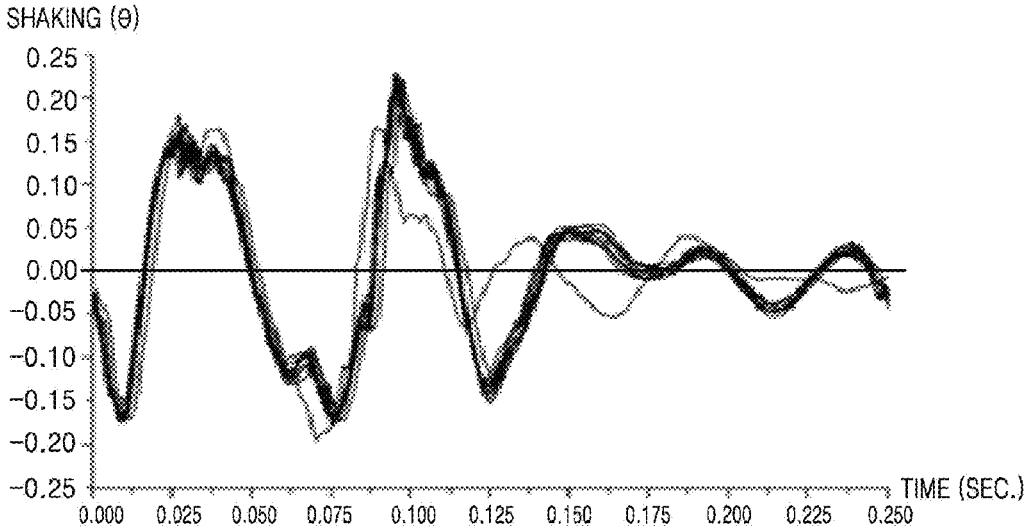

FIG. 3 is a graph showing a shaking pattern of the firing arm 100 obtained by overlapping the shakings of the firing arm 100 within a firing interval of about 0.18 seconds by dividing the graph of FIG. 2 into ten sections, and that a time when the firing arm 100 of FIG. 1 returns to the zero position after firing a bullet is selected as a firing time F1.

Referring to FIG. 3, it may be seen that patterns of shaking of the firing arm 100 during firing ten bullets are very similar to one another and the firing arm 100 may be located at the zero position within the interval of about 0.18 seconds.

As described above, the controller 400 may obtain a shaking pattern of FIG. 3 based on the shaking 8 of the firing arm 100 received from the detector 300 and may set one of times when the firing arm 100 located at the zero position returns to the zero position again after firing a bullet, as a firing time F1, by analyzing the shaking pattern.

As such, when the firing arm 100 fires a bullet at the zero position, a shaking pattern that is the same as the shaking pattern occurring after 0 seconds in the graph of FIG. 3 from the firing time F1 when a bullet is fired, is repeated. Accordingly, when the firing arm 100 consecutively fires bullets with a firing interval from 0 seconds to the firing time F1 determined by the controller 400, bullets are fired when the firing arm 100 passes the zero position and thus shooting accuracy may be greatly improved.

FIGS. 4A through 4D are graphs illustrating shaking patterns of the firing arm 100 of a remote weapon system 1 according to an exemplary embodiment under various firing conditions having different intrinsic physical properties.

The expression "various firing conditions having different intrinsic physical properties" means conditions when the intrinsic properties of the remote weapon system 1 are changed, that is, the shape, rigidity, or material of a constituent part of the remote weapon system 1 are changed. FIGS. 4A through 4D are graphs illustrating that the shaking of the firing arm 100 repeats a constant pattern when bullets are consecutively fired under various different conditions. However, since a detailed shape or material, or an accurate value of rigidity of the remote weapon system 1 are not core items to reveal the structure of effects of the exemplary embodiment, detailed descriptions thereof area omitted.

In the related art, when the intrinsic properties of such as the shape, material, or rigidity of the remote weapon system 1 are changed due to replacement of a part of the remote weapon system 1, design conditions for controlling the remote weapon system 1 are changed as well. However, in the remote weapon system 1 according to the exemplary embodiment, the design conditions do not need to be changed and, as the firing arm 100 fires a plurality of bullets to obtain shaking of the firing arm 100 that is intrinsic to the remote weapon system 1, a firing interval may be determined to easily improve shooting accuracy.

The above control method is an open-loop control method, in which a shaking pattern of the remote weapon system 1 is obtained through at least two times of firings and used as intrinsic properties of the remote weapon system 1, and a firing time of the firing arm 100 is determined by using the shaking pattern of the firing arm 100 obtained before an actual aimed shoot begins, thereby controlling the firing time of the remote weapon system 1.

Figure 5:
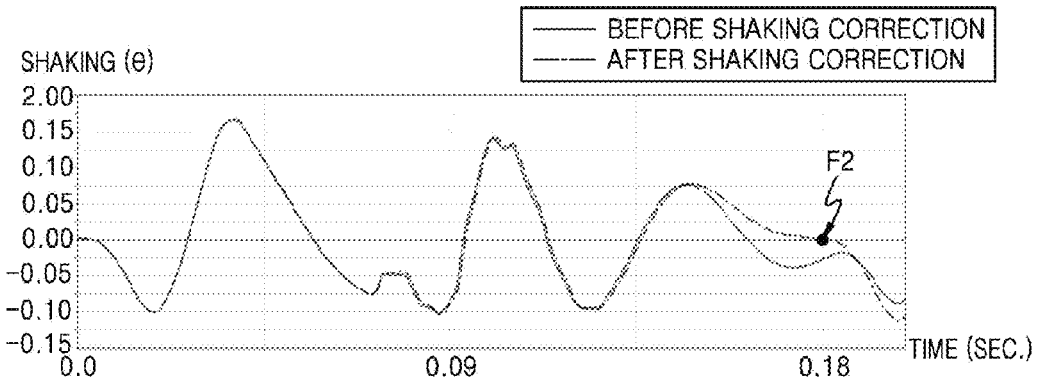
FIG. 5 is a graph showing that shaking of a firing arm is corrected as a driver operates while the firing arm of a remote weapon system according to another exemplary embodiment fires bullets.

FIG. 5 is a graph showing that shaking of the firing arm 100 is corrected as the driver 200 operates while the firing arm 100 of a remote weapon system according to another exemplary embodiment fires bullets. In the graph of FIG. 5, a solid line indicates a shaking pattern of the firing arm 100 before the shaking of the firing arm 100 is corrected and a dot-dash line indicates a shaking pattern after the shaking of the firing arm 100 is corrected by the operation of the driver 200.

As described above, referring back to FIG. 1, the controller 400 may include a determination processor 410 that determines control torque TS needed to control the position of the firing arm 100 to a zero position at the firing time F2 when a bullet is fired by analyzing the shaking pattern of the firing arm 100 and a signal converter 420 that converts the control torque TS to an electric signal and transmits the electric signal to the motor driver 220.

The firing time F2 is set to a time when the firing arm 100 does not arrive at the zero position. A principle of correcting the shaking of the firing arm 100 through the control of the controller 400 is described below.

First, referring to FIG. 1, the shaking of the firing arm 100 is measured by the detector 300 and transmitted to the controller 400. The controller 400 recognizes a shaking pattern from the shaking of the firing arm 100. Next, the determination processor 410 determines the control torque TS needed to control the position of the firing arm 100 to be located at the zero position at the firing time F2 that is determined by the controller 400 based on the shaking pattern. The control torque TS that is determined by the determination processor 410 is transmitted to the signal converter 420 and converted to an electric signal that is transmitted to the motor driver 220.

The motor driver 220 transmits the driving signal DS to the motor 210 based on the control torque TS received from the signal converter 420 of the controller 400. The motor 210 is driven by the driving signal DS and corrects the position of the firing arm 100 to be positioned at the zero position.

As such, when the controller 400 controls the movement of the firing arm 100 via the driver 200, even if the firing time of the firing arm 100 is not at the zero position, the control torque TS that is needed to position the firing arm 100 at the zero position is applied to the firing arm 100 via the driver 200. Accordingly, the firing arm 100 fires a bullet at the zero position so that shooting accuracy may be improved.

Figure 6:
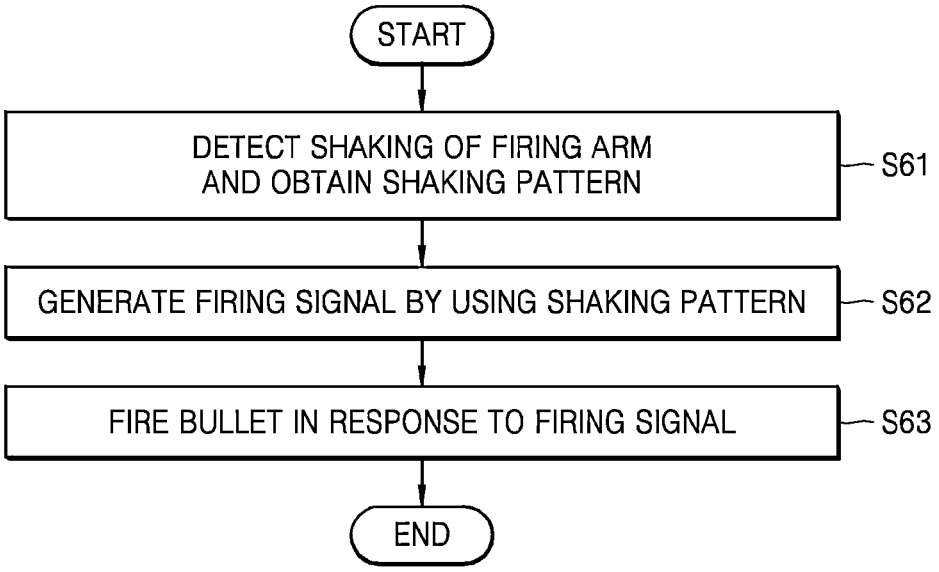
FIG. 6 is a flowchart for describing a process in which the detector and the driver of FIG. 1 control the firing arm according to an exemplary embodiment.

FIG. 6 is a flowchart for describing a process in which the detector 300 and the driver 200 of FIG. 1 control the firing arm 100.

A method of controlling a remote weapon illustrated in FIG. 6 includes detecting shaking of the firing arm 100 when firing a bullet and obtaining a shaking pattern as illustrated in FIGS. 3, 4A-4D, and 5 based on the obtained shaking of the firing arm 100 (S61), generating a firing signal FS by using the shaking pattern (S62), and firing a bullet in response to the firing signal FS (S63).

In order to obtain the shaking pattern of the firing arm 100 (S61), first, the firing arm 100 fires a plurality of bullets. When bullets are fired, the detector 300 detects shaking of the firing arm 100 with respect to the zero position pointing at a target and transmits information about the shaking of the firing arm 100 to the controller 400. The controller 400 obtains a shaking pattern of the firing arm 100 from the received information about the shaking of the firing arm 100 (S61). The controller 400 generates the firing signal FS determining the firing time when the firing arm 100 fires a bullet, based on the shaking pattern (S62), and the firing arm 100 fires a bullet in response to the firing signal FS (S63).

Figure 7:
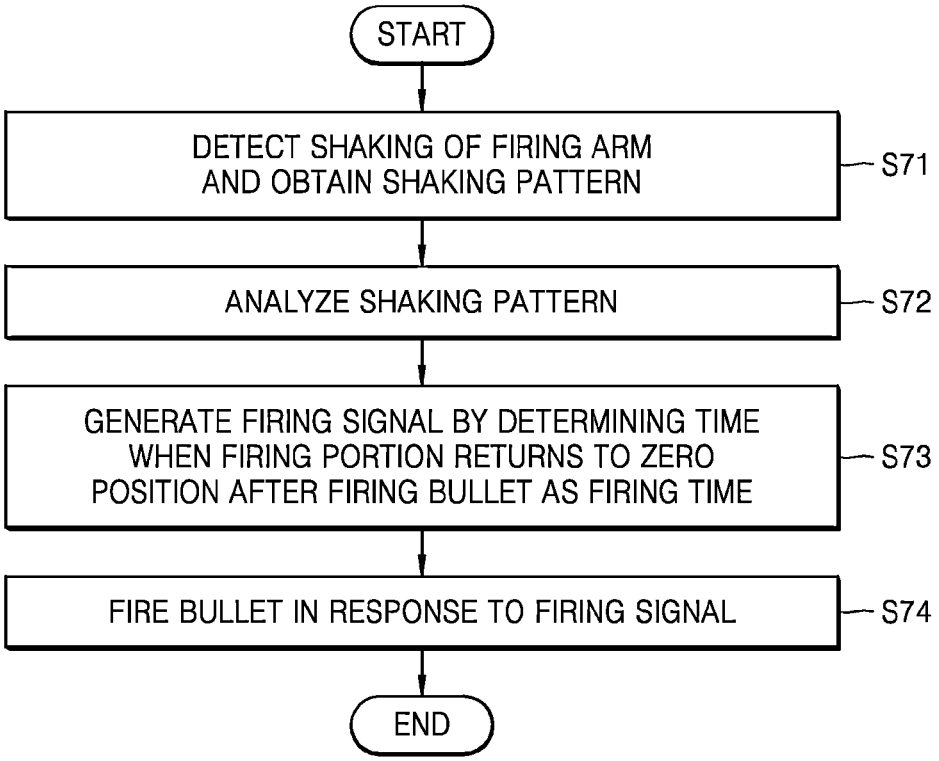
FIG. 7 is a flowchart for describing a process in which the controller controls driving of the firing arm so that the firing arm of FIG. 1 fires at a zero position according to an exemplary embodiment.

FIG. 7 is a flowchart for describing a process in which the controller 400 controls driving of the firing arm 100 so that the firing arm 100 of FIG. 1 fires at a zero position.

When the firing arm 100 consecutively fires a plurality of bullets at the zero position pointing at the target, the shooting accuracy is greatly improved.

A method of controlling a remote weapon illustrated in FIG. 7 includes detecting shaking of the firing arm 100 when firing a bullet and obtaining a shaking pattern based on the detected shaking of the firing arm 100 (S71), analyzing the shaking pattern (S72), determining a time when the firing arm 100 returns to the zero position after firing a bullet as a firing time and generating a firing signal FS (S73), and firing a bullet in response to the firing signal FS (S74).

The operation of obtaining a shaking pattern by detecting the shaking of the firing arm 100 (S71) is the same as the operation of obtaining of a shaking pattern (S61) described above with reference to FIG. 6. However, in addition to the operation of generating the firing signal FS (S62) by using the shaking pattern that is detected in the operation of extracting a shaking pattern (S61) illustrated in FIG. 6, the remote weapon control method of FIG. 7 further includes analyzing the shaking pattern extracted from the information about the shaking of the firing arm 100 that is transmitted from the detector 300 to the controller 400 (S72), determining a time when the firing arm 100 returns to the zero position after firing a bullet and generating the firing signal FS instructing firing of the firing arm 100 at the time when the firing arm 100 returns to the zero position (S73), and firing a bullet which is performed by the firing arm 100 (S74).

Figure 8:
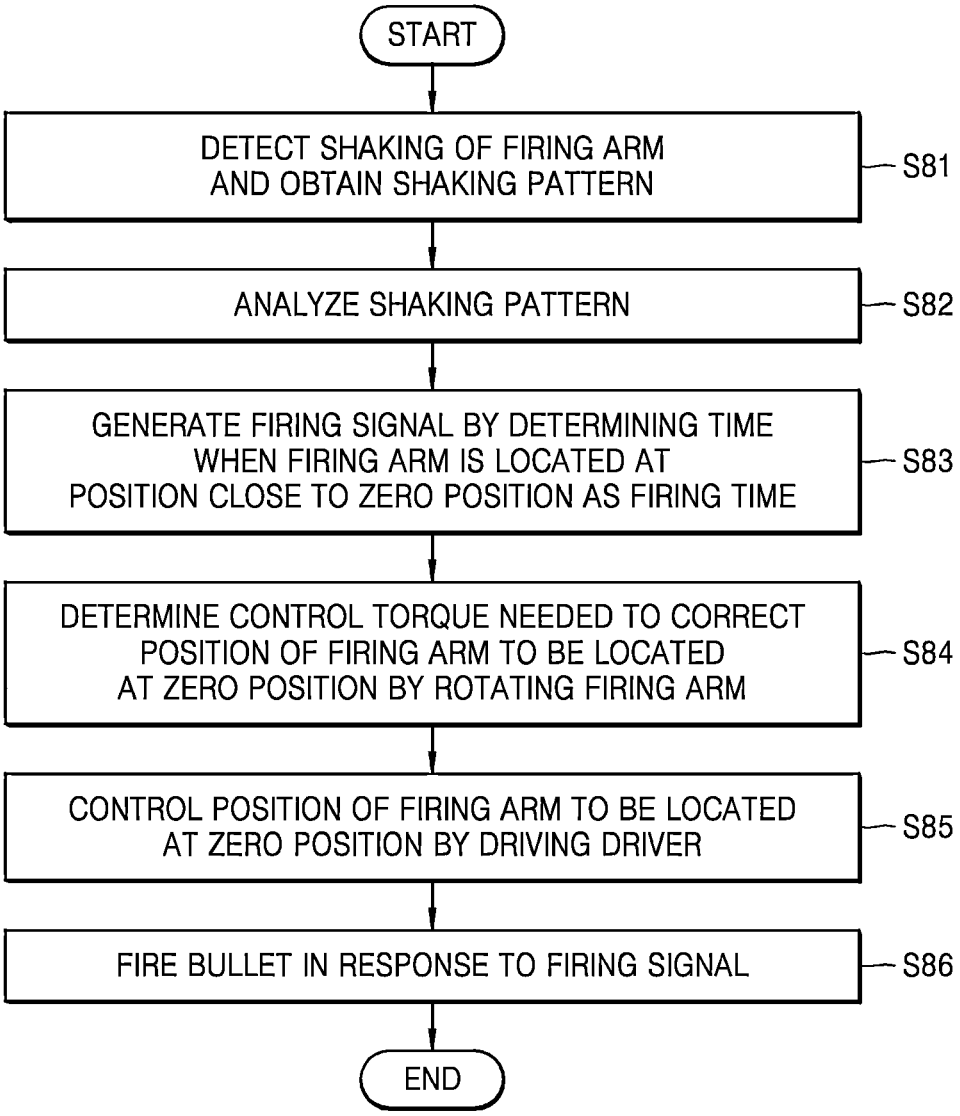
FIG. 8 is a flowchart for describing a process in which shaking of the firing arm is corrected through an operation of the driver of FIG. 5 while the firing arm fires bullets according to an exemplary embodiment.

FIG. 8 is a flowchart for describing a process in which shaking of the firing arm 100 is corrected through an operation of the driver 200 of FIG. 5 while the firing arm 100 fires bullets.

In a method of controlling a remote weapon illustrated in FIG. 8, like the method of controlling a remote weapon illustrated in FIG. 7, the controller 400 receives shaking of the firing arm 100 detected by the detector 300 and extracts a shaking pattern, and analyzes the shaking pattern to determine a time when the firing arm 100 returns to the zero position after firing a bullet (S81 and S82). In comparison with the exemplary embodiment disclosed in FIG. 7 in which the time when the firing arm 100 returns to the zero position is determined as a firing time, in the present exemplary embodiment, a time when the firing arm 100 is located at a position close to the zero position is determined as a firing time and the firing signal FS instructing to fire a bullet at the determined firing time is generated (S83)

The determination processor 410 analyzes the shaking pattern of the firing arm 100 and determines the control torque TS needed to control the position of the firing arm 100 to be positioned at the zero position at the firing time when a bullet is fired (S84). The signal converter 420 receives a value of the control torque TS from the determination processor 410 and transmits the value of the control torque TS to the motor driver 220. Next, the motor driver 220 transmits the driving signal DS to drive the driver 200 to the motor 210 and thus, when the remote weapon system 1 fires a bullet in response to the firing signal FS (S86), the shaking occurring in the firing arm 100 is corrected so that the position of the firing arm 100 is adjusted to be positioned at the zero position when a bullet is fired (S85).

As described above, when the shaking of the firing arm 100 is corrected by using the driver 200, even if a time when the firing arm 100 is not located at the zero position is determined as a firing time, the firing arm 100 fires a bullet by being moved to the zero position according to the control torque TS applied to the motor 210 and thus shooting accuracy of the remote weapon system 1 may be improved.

As described above, in the remote weapon system and control method thereof according to the one or more of the exemplary embodiments above, the shooting accuracy may be improved.

Also, the intrinsic physical properties of a remote weapon system are identified through a plurality of preliminary firings and used to control the firing time of the remote weapon system. Accordingly, when the intrinsic physical properties of a remote weapon system are changed, the remote weapon system does not need to be redesigned.

Also, since the open-loop control system is employed, the structure of a remote weapon system may be simplified and the cost of a remote weapon system may be reduced.

It should be understood that the exemplary embodiments described herein should be considered in a descriptive sense only and not for purposes of limitation. Descriptions of features or aspects within each exemplary embodiment should typically be considered as available for other similar features or aspects in other exemplary embodiments.

At least one of the components, elements or units represented by a block as illustrated by reference numerals 200, 300, 410 and 420 in FIG. 1 may be embodied as various numbers of hardware, software and/or firmware structures that execute respective functions described above, according to an exemplary embodiment. For example, at least one of these components, elements or units may use a direct circuit structure, such as a memory, processing, logic, a look-up table, etc. that may execute the respective functions through controls of one or more microprocessors or other control apparatuses. Also, at least one of these components, elements or units may be specifically embodied by a module, a program, or a part of code, which contains one or more executable instructions for performing specified logic functions. Also, at least one of these components, elements or units may further include a processor such as a central processing unit (CPU) that performs the respective functions, a microprocessor, or the like. Further, although a bus is not illustrated in the above block diagrams, communication between the components, elements or units may be performed through the bus. Functional aspects of the above exemplary embodiments may be implemented in algorithms that execute on one or more processors. Furthermore, the components, elements or units represented by a block or processing steps may employ any number of related art techniques for electronics configuration, signal processing and/or control, data processing and the like.

While exemplary embodiments have been described above, it will be understood by those of ordinary skill in the art that various changes in form and details may be made therein without departing from the spirit and scope of the inventive concept as defined by the following claims.

What is claimed is:

1. A remote weapon device comprising:

a firing arm configured to fire a bullet at a target in response to a firing signal;

a driver coupled to the firing arm and configured to move the firing arm to aim the firing arm at the target;

a detector configured to detect shaking of the firing arm with respect to a zero position, the shaking caused by a plurality of bullets being fired from the firing arm, the zero position corresponding to a position at which the firing arm points at the target and fires the bullet at the target, each bullet generating a partial shaking pattern after each bullet being fired; and a controller configured to obtain a shaking pattern based on the detected shaking overlapping the partial shaking pattern of each bullet and configured to generate the firing signal controlling a firing time when the firing arm fires the bullet according to the shaking pattern to control the firing arm to fire the bullet, wherein the shaking of the firing arm is generated from firing of bullet by the firing arm, and wherein the controller is configured to obtain the shaking pattern of the firing arm over a predetermined time while the firing arm fires the plurality of bullets.

2. The remote weapon device of claim 1, wherein the controller is configured to control the driver to position the firing arm at the zero position according to the shaking pattern.

3. The remote weapon device of claim 1, wherein the controller is configured to analyze the shaking pattern of the firing arm, configured to determine a time when the firing arm returns to the zero position after firing the bullet as the firing time and configured to generate the firing signal according to the time when the firing arm returns to the zero position.

4. The remote weapon device of claim 1, wherein the driver comprises:

a motor configured to move the firing arm; and a motor driver configured to apply a driving signal to the motor.

5. The remote weapon device of claim 4, wherein the motor is configured to rotate the firing arm.

6. The remote weapon device of claim 1, wherein the controller comprises:

a determination processor configured to analyze the shaking pattern and configured to determine a control torque controlling the position of the firing arm to be positioned at the zero position at the firing time when the bullet is fired; and a signal converter configured to convert the control torque to an electric signal and configured to transmit the electric signal to the motor driver.

7. The remote weapon device of claim 6, wherein the motor driver is configured to generate the driving signal based on the control torque, configured to transmit the driving signal to the motor and configured to correct the shaking of the firing arm.

8. The remote weapon device of claim 1, wherein the controller is connected to the firing arm, the driver, and the detector.

9. The remote weapon device of claim 1, wherein the controller is configured to generate the firing signal using an open-loop control method.

10. The remote weapon device of claim 9, wherein the controller is configured to identify intrinsic physical properties of the remote weapon device based on a plurality of preliminary firings of the firing arm and the shaking of the firing arm.

11. The remote weapon device of claim 1, wherein the shaking pattern corresponds to an angular movement pattern of the firing arm oscillating through the zero position.

12. A method of controlling a remote weapon, the method comprising:

detecting shaking of from a firing arm with respect to a zero position, the shaking caused by a plurality of bullets being fired from the firing arm, the zero position corresponding to a position at which the firing arm points at a target and fires the plurality of bullets at the target, each bullet generating a partial shaking pattern after each bullet being fired;

obtaining a shaking pattern of the firing arm based on the shaking of the firing arm by overlapping the partial shaking pattern of each bullet;

generating a firing signal controlling the firing arm to fire a bullet according to the shaking pattern; and firing, by the firing arm, the bullet in response to the firing signal, wherein the shaking of the firing arm is generated from firing of the plurality of bullets by the firing arm, and wherein the shaking pattern of the firing arm is obtained over a predetermined time while the firing arm fires the plurality of bullets.

13. The method of claim 12, wherein the generating the firing signal comprises:

analyzing the shaking pattern of the firing arm; and generating the firing signal by determining a time when the firing arm returns to the zero position after firing the bullet as a firing time.

14. The method of claim 12, wherein, in the generating the firing signal, the firing signal is generated by determining a time when the firing arm is located at a position within a predetermined position to the zero position, as a firing time, and the method further comprises:

determining a control torque to control the position of the firing arm to be located at the zero position at the firing time; and driving a driver configured to move the firing arm according to the control torque to control the position of the firing arm to be located at the zero position at the firing time.

15. The method of claim 12, wherein the generating the firing signal comprises generating the firing signal using an open-loop control method.

16. The method of claim 12, wherein the generating the firing signal further comprises identifying intrinsic physical properties of the remote weapon based on a plurality of preliminary firings of the firing arm and the shaking of the firing arm.

17. The method of claim 12, wherein the shaking pattern corresponds to an angular movement pattern of the firing arm oscillating through the zero position.

* * * * *